US008000968B1

(12) United States Patent
Liu et al.

(10) Patent No.: US 8,000,968 B1
(45) Date of Patent: Aug. 16, 2011

(54) METHOD AND APPARATUS FOR SWITCHING SPEECH OR AUDIO SIGNALS

(75) Inventors: Zexin Liu, Beijing (CN); Lei Miao, Beijing (CN); Chan Hu, Shenzhen (CN); Wenhai Wu, Beijing (CN); Yue Lang, Munich (DE); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/094,340

(22) Filed: Apr. 26, 2011

(51) Int. Cl.
*G10L 19/00* (2006.01)

(52) U.S. Cl. ..... 704/268; 704/501; 704/200.1; 704/229; 704/230; 704/220; 381/94.3; 381/98; 381/106; 375/242; 370/477; 379/102.01; 725/68

(58) Field of Classification Search ..... 704/229, 704/230, 220, 500, 201, 222, 219, 224, 208, 704/504, 501, 268, 200.1; 381/94.3, 98, 381/106, 320, 51, 97; 375/242, 241; 370/477; 725/68; 379/102.01
See application file for complete search history.

(56) References Cited

U.S. PATENT DOCUMENTS

| | | | | |
|---|---|---|---|---|
| 4,769,833 | A * | 9/1988 | Farleigh et al. | 379/102.01 |
| 5,019,910 | A * | 5/1991 | Filmer | 725/68 |
| 2004/0088742 | A1 | 5/2004 | LeBlanc et al. | |
| 2005/0078839 | A1 * | 4/2005 | Miura et al. | 381/98 |
| 2005/0285183 | A1 | 12/2005 | Baik | |
| 2006/0149538 | A1 | 7/2006 | Lee et al. | |
| 2007/0174050 | A1 * | 7/2007 | Li et al. | 704/208 |
| 2008/0267416 | A1 * | 10/2008 | Goldstein et al. | 381/56 |
| 2009/0094038 | A1 | 4/2009 | Chivukula et al. | |
| 2009/0292537 | A1 | 11/2009 | Ehara et al. | |

FOREIGN PATENT DOCUMENTS

| | | | |
|---|---|---|---|
| CN | 1261713 | A | 8/2000 |
| CN | 101076853 | A | 11/2007 |
| EP | 1008984 | A2 | 6/2000 |
| EP | 1408615 | A2 | 4/2004 |
| EP | 1677289 | A2 | 7/2006 |
| EP | 1818913 | A1 | 8/2007 |
| WO | 2006062202 | A1 | 6/2006 |

* cited by examiner

*Primary Examiner* — Vijay Chawan
(74) *Attorney, Agent, or Firm* — Conley Rose, P.C.; Grant Rodolph

(57) ABSTRACT

A method and an apparatus for switching speech or audio signals, wherein the method for switching speech or audio signals includes when switching of a speech or audio, weighting a first high frequency band signal of a current frame of speech or audio signal and a second high frequency band signal of the previous M frame of speech or audio signals to obtain a processed first high frequency band signal, where M is greater than or equal to 1, and synthesizing the processed first high frequency band signal and a first low frequency band signal of the current frame of speech or audio signal into a wide frequency band signal. In this way, speech or audio signals with different bandwidths can be smoothly switched, thus improving the quality of audio signals received by a user.

10 Claims, 8 Drawing Sheets

METHOD AND APPARATUS FOR SWITCHING SPEECH OR AUDIO SIGNALS

CROSS-REFERENCE TO RELATED APPLICATION

This application claims priority from Chinese Patent Application No. 201010163406.3, filed on Apr. 28, 2010, which is hereby incorporated by reference in its entirety.

FIELD OF THE INVENTION

The present invention relates to communication technologies, and in particular, to a method and an apparatus for switching speech or audio signals.

BACKGROUND OF THE INVENTION

Currently, during the process of transmitting speech or audio signals on a network, because the network conditions may vary, the network may intercept the bit stream of the speech or audio signals transmitted from an encoder to the network with different bit rates, so that the decoder may decode the speech or audio signals with different bandwidths from the intercepted bit stream.

In the prior art, because the speech or audio signals transmitted on the network have different bandwidths, the bidirectional switching from/to a narrow frequency band speech or audio signal to/from a wide frequency band speech or audio signal may occur during the process of transmitting speech or audio signals. In embodiments of the present invention, the narrow frequency band signal is switched to a wide frequency band signal with only a low frequency band component through up-sampling and low-pass filtering; the wide frequency band speech or audio signal includes both a low frequency band signal component and a high frequency band signal component.

During the implementation of the present invention, the inventor discovers at least the following problems in the prior art: Because high frequency band signal information is available in wide frequency band speech or audio signals but is absent in narrow frequency band speech or audio signals, when speech or audio signals with different bandwidths are switched, a energy jump may occur in the speech or audio signals resulting in uncomfortable feeling in listening, and thus reducing the quality of audio signals received by a user.

SUMMARY OF THE INVENTION

Embodiments of the present invention provide a method and an apparatus for switching speech or audio signals to smoothly switch speech or audio signals between different bandwidths, thereby improving the quality of audio signals received by a user.

A method for switching speech or audio signals includes: when switching of a speech or audio signal, weighting a first high frequency band signal of a current frame of speech or audio signal and a second high frequency band signal of the previous M frame of speech or audio signals to obtain a processed first high frequency band signal, wherein, M is greater than or equal to 1; and synthesizing the processed first high frequency band signal and a first low frequency band signal of the current frame of speech or audio signal into a wide frequency band signal.

An apparatus for switching speech or audio signals includes: a processing module, to: when switching of a speech or audio, weight a first high frequency band signal of a current frame of speech or audio signal and a second high frequency band signal of the previous M frame of speech or audio signals to obtain a processed first high frequency band signal, wherein, M is greater than or equal to 1; and a first synthesizing module, to: synthesize the processed first high frequency band signal and a first low frequency band signal of the current frame of speech or audio signal into a wide frequency band signal.

By using the method and apparatus for switching speech or audio signals in embodiments of the present invention, the first high frequency band signal of the current frame of speech or audio signal is processed according to the second high frequency band signal of the previous M frame of speech or audio signals, so that the second high frequency band signal of the previous M frame of speech or audio signals can be smoothly switched to the processed first high frequency band signal; the processed first high frequency band signal and the first low frequency band signal are synthesized into a wide frequency band signal. In this way, during the process of switching between speech or audio signals with different bandwidths, these speech or audio signals can be smoothly switched, thus reducing the ill impact of the energy jump on the subjective audio quality of the speech or audio signals and improving the quality of speech or audio signals received by the user.

BRIEF DESCRIPTION OF THE DRAWINGS

To make the technical solution of the present invention clearer, the accompanying drawings for illustrating the embodiments of the present invention are outlined below. Apparently, the accompanying drawings are exemplary only, and those skilled in the art can derive other drawings from such accompanying drawings without creative efforts.

DETAILED DESCRIPTION OF THE EMBODIMENTS

To facilitate the understanding of the object, technical solution, and merit of the present invention, the following describes the present invention in detail with reference to embodiments and accompanying drawings. Apparently, the embodiments are exemplary only and the present invention is not limited to such embodiments. Persons having ordinary skill in the related art can derive other embodiments from the embodiments given herein without making remarkable creative effort, and all such embodiments are covered in the scope of the present invention.

The narrow frequency band signal and wide frequency band signal mentioned in embodiments of the present invention are two relative concepts and refer to two signals with different bandwidths. Ultra-wideband signals and wideband signals may be considered as wide frequency band signals, while wideband signals and narrowband signals may be considered as narrow frequency band signals.

Figure 1:
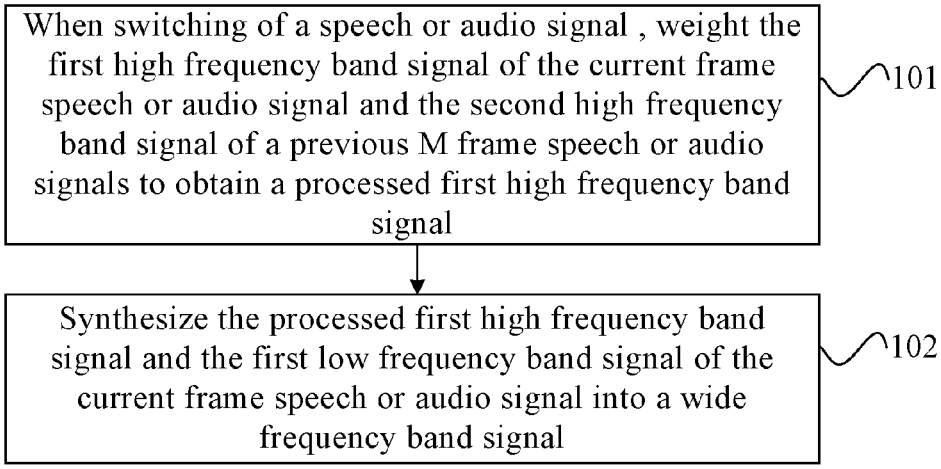
FIG. 1 is a flowchart of a first embodiment of a method for switching speech or audio signals.

FIG. 1 is a flowchart of the first embodiment of a method for switching speech or audio signals. As shown in FIG. 1, by using the method for switching speech or audio signals, when switching of a speech or audio, each frame after a switching frame is processed according to the following steps:

Step 101: When switching of a speech or audio, weight the first high frequency band signal of the current frame of speech or audio signal and the second high frequency band signal of a previous M frame of speech or audio signals to obtain a processed first high frequency band signal, where M is greater than or equal to 1.

Step 102: Synthesize the processed first high frequency band signal and the first low frequency band signal of the current frame of speech or audio signal into a wide frequency band signal.

In this embodiment, the previous M frame of speech or audio signals refer to M frame of speech or audio signals before the current frame. The L frame of speech or audio signals before the switching refer to L frame of speech or audio signals before the switching frame when switching of a speech or audio. If the current speech frame is a wide frequency band signal but the previous speech frame is a narrow frequency band signal or if the current speech frame is a narrow frequency band signal but the previous speech frame is a wide frequency band signal, the speech or audio signal is switched and the current speech frame is the switching frame.

By using the method for switching speech or audio signals in this embodiment, the first high frequency band signal of the current frame of speech or audio signal is processed according to the second high frequency band signal of the previous M frame of speech or audio signals, so that the second high frequency band signal of the previous M frame of speech or audio signals can be smoothly switched to the processed first high frequency band signal. In this way, during the process of switching between speech or audio signals with different bandwidths, the high frequency band signal of these speech or audio signals can be smoothly switched. Finally, the processed first high frequency band signal and the first low frequency band signal are synthesized into a wide frequency band signal; the wide frequency band signal is transmitted to a user terminal, so that the user enjoys a high quality speech or audio signal. By using the method for switching speech or audio signals in this embodiment, speech or audio signals with different bandwidths can be switched smoothly, thus reducing the impact of the sudden energy change on the subjective audio quality of the speech or audio signals and improving the quality of speech or audio signals received by the user.

Figure 2:
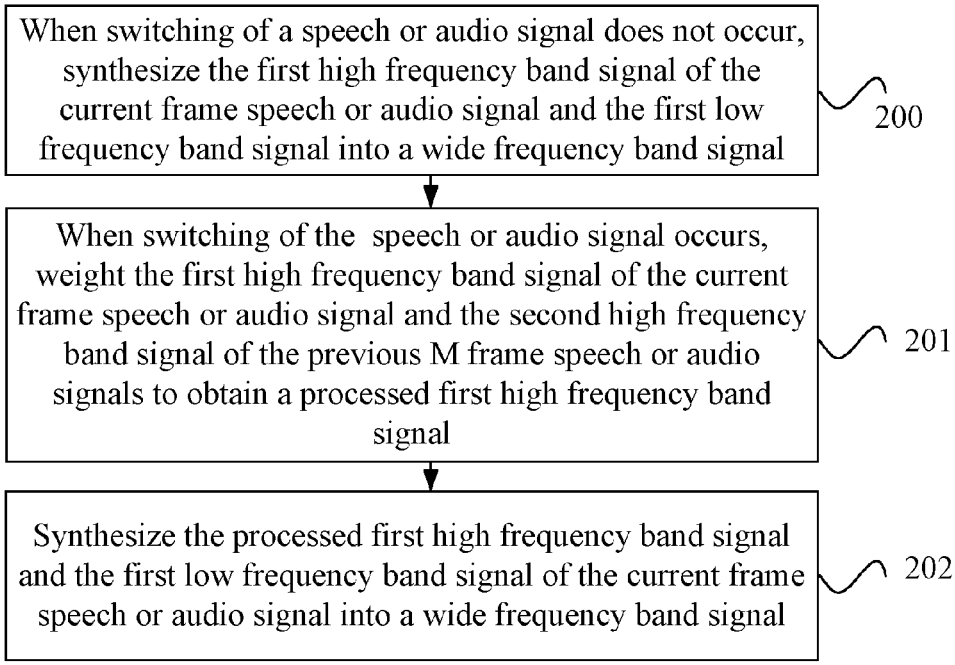
FIG. 2 is a flowchart of a second embodiment of the method for switching speech or audio signals.

FIG. 2 is a flowchart of the second embodiment of the method for switching speech or audio signals. As shown in FIG. 2, the method includes the following steps:

Step 200: When switching of the speech or audio signal does not occur, synthesize the first high frequency band signal of the current frame of speech or audio signal and the first low frequency band signal into a wide frequency band signal.

Specifically, the first frequency band speech or audio signal in this embodiment may be a wide frequency band speech or audio signal or a narrow frequency band speech or audio signal. When the first frequency band speech or audio signal is not switched during the transmission of the speech or audio signal, the operation may be executed according to the following two cases: (1) If the first frequency band speech or audio signal is a wide frequency band speech or audio signal, the low frequency band signal and high frequency band signal of the wide frequency band speech or audio signals are synthesized into a wide frequency band signal. (2) If the first frequency band speech or audio signal is a narrow frequency band speech or audio signal, the low frequency band signal and the high frequency band signal of the narrow frequency band speech or audio signal are synthesized into a wide frequency band signal. In this case, although the signal is a wide frequency band signal, the high frequency band is null.

Step 201: When the speech or audio signal is switched, weight the first high frequency band signal of the current frame of speech or audio signal and the second high frequency band signal of a previous M frame of speech or audio signals to obtain a processed first high frequency band signal. M is greater than or equal to 1.

Specifically, when the switching between speech or audio signals with different bandwidths occurs, the first high frequency band signal of the current frame of speech or audio signal is processed according to the second high frequency band signal of the previous M frame of speech or audio signals, so that the second high frequency band signal of the previous M frame of speech or audio signals can be smoothly switched to the processed first high frequency band signal. For example, when the wide frequency band speech or audio signal is switched to the narrow frequency band speech or audio signal, because the high frequency band signal information corresponding to the narrow frequency band speech or audio signal is null, the component of the high frequency band signal corresponding to the narrow frequency band speech or audio signal needs to be restored to enable the wide frequency band speech or audio signal to be smoothly switched to the narrow frequency band speech or audio signal. However, when the narrow frequency band speech or audio signal is switched to the wide frequency band speech or audio signal, because the high frequency band signal of the wide frequency band speech or audio signal is not null, the energy of the high frequency band signals of consecutive multiple-frame wide frequency band speech or audio signals after the switching must be weakened to enable the narrow frequency band speech or audio signal to be smoothly switched to the wide frequency band speech or audio signal, so that the high frequency band signal of the wide frequency band speech or audio signal is gradually switched to a real high frequency band signal. By processing the current frame of speech or audio signal in step 201, high frequency band signals in speech or audio signals with different bandwidths can be smoothly switched, which avoids uncomfortable listening of the user due to the sudden energy change in the process of switching between the wide frequency band speech or audio signal and the narrow frequency band speech or audio signal, enabling the user to receive high quality audio signals. To simplify the process of obtaining the processed first high frequency band signal, the first high frequency band signal and the second high frequency band signal of a previous M frame of speech or audio signals may be directly weighted. The weighted result is the processed first high frequency band signal.

Step 202: Synthesize the processed first high frequency band signal and the first low frequency band signal of the current frame of speech or audio signal into a wide frequency band signal.

Specifically, after the current frame of speech or audio signal is processed in step 201, the second high frequency band signal of a previous M frame of speech or audio signals can be smoothly switched to the processed first high frequency band signal of the current frame; then, in step 202, the processed first high frequency band signal and the first low frequency band signal of the current frame of speech or audio signal are synthesized into a wide frequency band signal, so that the speech or audio signals received by the user are always wide frequency band speech or audio signals. In this way, speech or audio signals with different bandwidths are smoothly switched, which helps improve the quality of audio signals received by the user.

By using the method for switching speech or audio signals in this embodiment, the first high frequency band signal of the current frame of speech or audio signal is processed according to the second high frequency band signal of a previous M frame of speech or audio signals, so that the second high frequency band signal of the previous M frame of speech or audio signals can be smoothly switched to the processed first high frequency band signal. In this way, during the process of switching between speech or audio signals with different bandwidths, the high frequency band signal of these speech or audio signals can be smoothly switched. Finally, the processed first high frequency band signal and the first low frequency band signal are synthesized into a wide frequency band signal; the wide frequency band signal is transmitted to a user terminal, so that the user enjoys a high quality speech or audio signal. By using the method for switching speech or audio signals in this embodiment, speech or audio signals with different bandwidths can be switched smoothly, thus reducing the impact of the sudden energy change on the subjective audio quality of the speech or audio signals and improving the quality of audio signals received by the user. In addition, when speech or audio signals with different bandwidths are not switched, the first high frequency band signal and the first low frequency band signal of the current frame of speech or audio signal are synthesized into a wide frequency band signal, so that the user can obtain high quality audio signal.

Figure 3:
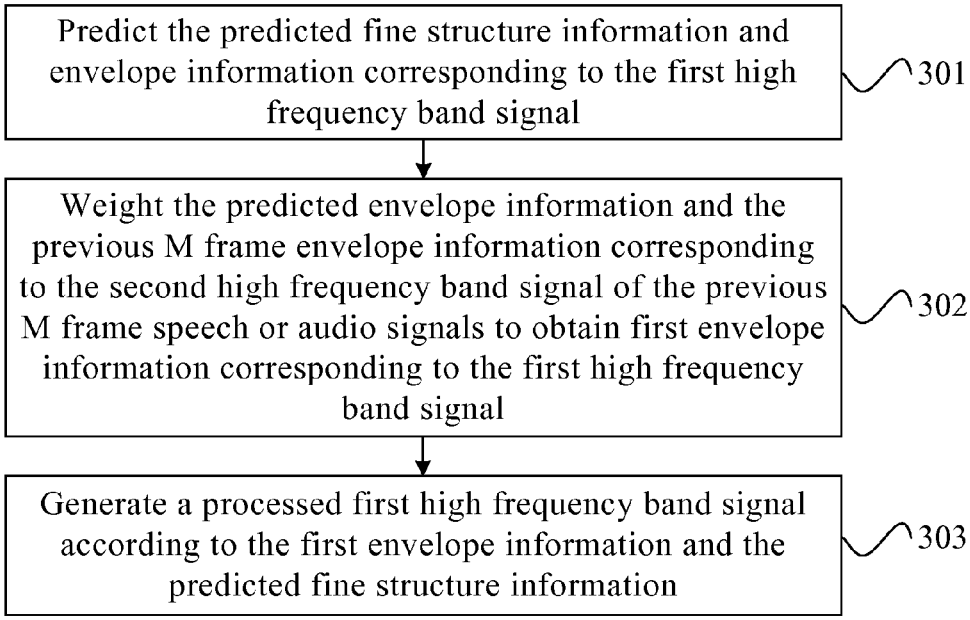
FIG. 3 is a flowchart of an embodiment of step 201 shown in FIG. 2.

According to the preceding technical solution, optionally, as shown in FIG. 3, when switching from wide frequency band speech or audio signal to a narrow frequency band speech or audio signal, step 201 includes the following steps:

Step 301: Predict a fine structure information and an envelope information corresponding to the first high frequency band signal.

Specifically, the speech or audio signal may be divided into fine structure information and envelope information, so that the speech or audio signal can be restored according to the fine structure information and envelope information. In the process of switching from a wide frequency band speech or audio signal to a narrow frequency band speech or audio signal, because only a low frequency band signal is available in the narrow frequency band speech or audio signal and the high frequency band signal is null, to enable the wide frequency band speech or audio signal to be smoothly switched to the narrow frequency band speech or audio signal, the high frequency band signal needed by the current narrow frequency band speech or audio signal needs to be restored so as to implement smooth switching between speech or audio signals. In step 301, the predicted fine structure information and envelope information corresponding to the first high frequency band signal of the narrow frequency band speech or audio signal are predicted.

To predict the fine structure information and envelope information corresponding to the current frame of speech or audio signal more accurately, the first low frequency band signal of the current frame of speech or audio signal may be classified in step 301, and then the predicted fine structure information and envelope information corresponding to the first high frequency band signal are predicted according to a signal type of the first low frequency band signal. For example, the narrow frequency band speech or audio signal of the current frame may be a harmonic signal, or a non-harmonic signal or a transient signal. In this case, the fine structure information and envelope information corresponding to the type of the narrow frequency band speech or audio signal can be obtained, so that the fine structure information and envelope information corresponding to the high frequency band signal can be predicted more accurately. The method for switching speech or audio signals in this embodiment does not limit the signal type of the narrow frequency band speech or audio signal.

Step 302: Weight the predicted envelope information and the previous M frame envelope information corresponding to the second high frequency band signal of the previous M frame of speech or audio signals to obtain first envelope information corresponding to the first high frequency band signal.

Specifically, after the predicted fine structure information and envelope information corresponding to the first high frequency band signal of the current frame are predicted in step 301, the first envelope information corresponding to the first high frequency band signal may be generated according to the predicted envelope information and the previous M frame envelope information corresponding to the second high frequency band signal of the previous M frame of speech or audio signals.

Figure 4:
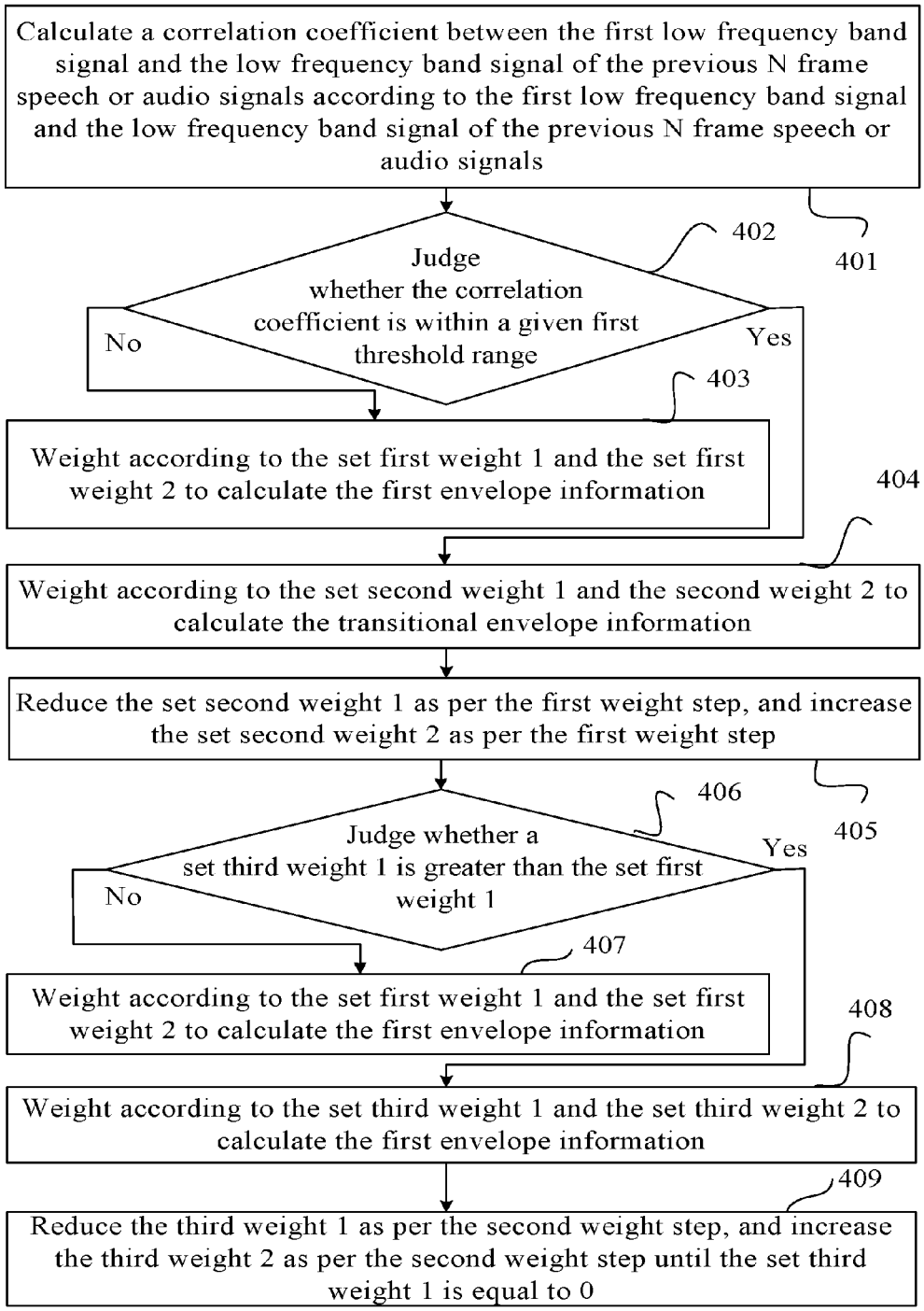
FIG. 4 is a flowchart of an embodiment of step 302 shown in FIG. 3.

Specifically, the process of generating the first envelope information corresponding to the first high frequency band signal in step 302 may be implemented by using the following two modes:

1. As shown in FIG. 4, an embodiment of obtaining the first envelope information through step 302 may include the following steps:

Step 401: Calculate a correlation coefficient between the first low frequency band signal and the low frequency band signal of a previous N frame of speech or audio signals according to the first low frequency band signal and the low frequency band signal of a previous N frame of speech or audio signals, where N is greater than or equal to 1.

Specifically, the first low frequency band signal of the current frame of speech or audio signal is compared with the low frequency band signal of the previous N frame of speech or audio signals to obtain a correlation coefficient between the first low frequency band signal of the current frame of speech or audio signal and the low frequency band signal of the previous N frame of speech or audio signals. For example, the correlation between the first low frequency band signal of the current frame of speech or audio signal and the low frequency band signal of the previous N frame of speech or audio signals may be determined by judging the difference between a frequency band of the first low frequency band signal of the current frame of speech or audio signal and the same frequency band of the low frequency band signal of the previous N frame of speech or audio signals in terms of the energy size or the information type, so that the desired correlation coefficient can be calculated. The previous N frame of speech or audio signals may be narrow frequency band speech or audio signals, wide frequency band speech or audio signals, or hybrid signals of narrow frequency band speech or audio signals and wide frequency band speech or audio signals.

Step 402: Judge whether the correlation coefficient is within a given first threshold range.

Specifically, after the correlation coefficient is calculated in step 401, whether the correlation coefficient is within the given threshold range is judged. The purpose of calculating the correlation coefficient is to judge whether the current frame of speech or audio signal is gradually switched from the previous N frame of speech or audio signals or suddenly switched from the previous N frame of speech or audio signals. That is, the purpose is to judge whether their characteristics are the same and then determine the weight of the high frequency band signal of the previous frame in the process of predicting the high frequency band signal of the current speech or audio signal. For example, if the first low frequency band signal of the current frame of speech or audio signal has the same energy as the low frequency band signal of the previous frame of speech or audio signal and their signal types are the same, it indicates that the previous frame of speech or audio signal is highly correlated with the current frame of speech or audio signal. Therefore, to accurately restore the first envelope information corresponding to the current frame of speech or audio signal, the high frequency band envelope information or transitional envelope information corresponding to the previous frame of speech or audio signal occupies a larger weight; otherwise, if there is a huge difference between the first low frequency band signal of the current frame of speech or audio signal and the low frequency band signal of the previous frame of speech or audio signal in terms of energy and their signal types are different, it indicates that the previous speech or audio signal is correlated with the current frame of speech or audio signal. Therefore, to accurately restore the first envelope information corresponding to the current frame of speech or audio signal, the high frequency band envelope information or transitional envelope information corresponding to the previous frame of speech or audio signal occupies a smaller weight.

Step 403: If the correlation coefficient is not within the given first threshold range, weight according to a set first weight 1 and a set first weight 2 to calculate the first envelope information. The set first weight 1 refers to the weight value of the previous frame envelope information corresponding to the high frequency band signal of the previous frame of speech or audio signal, and the set first weight 2 refers to the weight value of the predicted envelope information.

Specifically, if the correlation coefficient is determined to be not within the given first threshold range in step 402, it indicates that the current frame of speech or audio signal is slightly correlated with the previous N frame of speech or audio signals. Therefore, the previous M frame envelope information or transitional envelope information corresponding to the first frequency band speech or audio signal of the previous M frames or the high frequency band envelope information corresponding to the previous frame of speech or audio signal has a slight impact on the first envelope information. When the first envelope information corresponding to the current frame of speech or audio signal is restored, the previous M frame envelope information or transitional envelope information corresponding to the first frequency band speech or audio signal of the previous M frames or the high frequency band envelope information corresponding to the previous frame of speech or audio signal occupies a smaller weight. Therefore, the first envelope information of the current frame may be calculated according to the set first weight 1 and the set first weight 2. The set first weight 1 refers to the weight value of the envelope information corresponding to the high frequency band signal of the previous frame of speech or audio signal. The previous frame of speech or audio signal may be a wide frequency band speech or audio signal or a processed narrow frequency band speech or audio signal. In the case of first switching, the previous frame of speech or audio signal is the wide frequency band speech or audio signal, while the set first weight 2 refers to the weight value of the predicted envelope information. The product of the predicted envelope information and the set first weight 2 is added to the product of the previous frame envelope information and the set first weight 1, and the weighted sum is the first envelope information of the current frame. In addition, subsequently transmitted speech or audio signals are processed according to this method and weight. The first envelope information corresponding to the speech or audio signal is restored until a speech or audio signal is switched again.

Step 404: If the correlation coefficient is within the given first threshold range, weight according to a set second weight 1 and a set second weight 2 to calculate the transitional envelope information. The set second weight 1 refers to the weight value of the envelope information before the switching, and the set second weight 2 refers to the weight value of the previous M frame envelope information, where M is greater than or equal to 1.

Specifically, if the correlation coefficient is determined to be within the given threshold range in step 402, the current frame of speech or audio signal has characteristics similar to those of the previous consecutive N frame of speech or audio signals, and the first envelope information corresponding to the current frame of speech or audio signal is greatly affected by the envelope information of the previous consecutive N frame of speech or audio signals. In view of the authenticity of the previous M frame envelopes, the transitional envelope information corresponding to the current frame of speech or audio signal needs to be calculated according to the previous M frame envelope information and the envelope information before the switching. When the first envelope information of the current frame of speech or audio signal is restored, the previous M frame envelope information and the previous L frame envelope information before the switching should occupy a larger weight. Then, the first envelope information is calculated according to the transitional envelope information. The set second weight 1 refers to the weight value of the envelope information before the switching, and the set second weight 2 refers to the weight value of the previous M frame envelope information. In this case, the product of the envelope information before the switching and the set second weight 1 is added to the product of the previous M frame envelope information and the set second weight 2, and the weighted value is the transitional envelope information.

Step 405: Decrease the set second weight 1 as per the first weight, and increase the set second weight 2 as per the first weight.

Specifically, as the speech or audio signals are transmitted, the impact of the wide frequency band speech or audio signals before the switching on the subsequent narrow frequency band speech or audio signals is gradually decreased. To calculate the first envelope information more accurately, adaptive adjustment needs to be performed on the set second weight 1 and the set second weight 2. Because the impact of the L frame wide frequency band speech or audio signals before the switching on the subsequent speech or audio signals is decreased gradually, the value of the set second weight 1 turns smaller gradually, while the value of the set second weight 2 turns larger gradually, thus weakening the impact of the envelope information before the switching on the first envelope information. In step 405, the set second weight 1 and the set second weight 2 may be modified according to the following formulas: New second weight 1=Old set second weight 1−First weight step; New second weight 2=Old set second weight 2+First weight step, where the first weight step is a set value.

Step 406: Judge whether a set third weight 1 is greater than the set first weight 1.

Specifically, the set third weight 1 refers to the weight value of the transitional envelope information. The impact of the transitional envelope information on the first envelope information of the current frame may be determined by comparing the set third weight 1 with the set second weight 1. The transitional envelope information is calculated according to the previous M frame envelope information and the envelope information before the switching. Therefore, the set third weight 1 actually represents the degree of the impact that the first envelope information suffers from the envelope information before the switching.

Step 407: If the set third weight 1 is not greater than the set first weight 1, weight according to the set first weight 1 and the set first weight 2 to calculate the first envelope information.

Specifically, when the set third weight 1 is determined to be smaller than or equal to the set first weight 1 in step 406, it indicates that the current frame of speech or audio signal is a little far from the L frame of speech or audio signals before the switching and that the first envelope information is mainly affected by the previous M frame envelope information. Therefore, the first envelope information of the current frame may be calculated according to the set first weight 1 and the set first weight 2.

Step 408: If the set third weight 1 is greater than the set first weight 1, weight according to the set third weight 1 and the set third weight 2 to calculate the first envelope information. The set third weight 1 refers to the weight value of the transitional envelope information, and the set third weight 2 refers to the weight value of the predicted envelope information.

Specifically, if the set third weight 1 is determined to be greater than the set first weight 1 in step 406, it indicates that the current frame of speech or audio signal is closer to the L frame of speech or audio signals before the switching and that the first envelope information is greatly affected by the envelope information before the switching. Therefore, the first envelope information of the current frame needs to be calculated according to the transitional envelope information. The set third weight 1 refers to the weight value of the transitional envelope information, and the set third weight 2 refers to the weight value of the predicted envelope information. In this case, the product of the transitional envelope information and the set third weight 1 is added to the product of the predicted envelope information and the set third weight 2, and the weighted value is the first envelope information.

Step 409: Decrease the set third weight 1 as per the second weight step, and increase the set third weight 2 as per the second weight step until the set third weight 1 is equal to 0.

Specifically, the purpose of modifying the set third weight 1 and the set third weight 2 in step 409 is the same as that of modifying the set second weight 1 and the set second weight 2 in step 405, that is, the purpose is to perform adaptive adjustment on the set third weight 1 and the set third weight 2 to calculate the first envelope information more accurately when the impact of the L frame of speech or audio signals before the switching on the subsequently transmitted speech or audio signals is decreased gradually. Because the impact of the L frame of speech or audio signals before the switching on the subsequent speech or audio signals is decreased gradually, the value of the set third weight 1 turns smaller gradually, while the value of the set third weight 2 turns larger gradually, thus weakening the impact of the envelope information before the switching on the first envelope information. In step 409, the set third weight 1 and the set third weight 2 may be modified according to the following formulas: New third weight 1=Old third weight 1−Set second weight step; New third weight 2=Old third weight 2+Set second weight step, where the set second weight step is a set value.

The sum of the set first weight 1 and the set first weight 2 is equal to 1; the sum of the set second weight 1 and the set second weight 2 is equal to 1; the sum of the set third weight 1 and the set third weight 2 is equal to 1; the initial value of the set third weight 1 is greater than the initial value of the set first weight 1; and the set first weight 1 and the set first weight 2 are fixed constants. Specifically, the weight 1 and the weight 2 in this embodiment actually represent the percentages of the envelope information before the switching and the previous M frame envelope information in the first envelope information of the current frame. If the current frame of speech or audio signal is close to the L frame of speech or audio signals before the switching and their correlation is high, the percentage of the envelope information before the switching is high, while the percentage of the previous M frame envelope information is low. If the current frame of speech or audio signal is a little far from the L frame of speech or audio signals before the switching, it indicates that the speech or audio signal is stably transmitted on the network; or if the current frame of speech or audio signal is slightly correlated with the L frame of speech or audio signals before the switching, it indicates that the characteristics of the current frame of speech or audio signal are already changed. Therefore, if the current frame of speech or audio signal is slightly affected by the L frame of speech or audio signals before the switching, the percentage of the envelope information before the switching is low.

In addition, step 404 may be executed after step 405. That is, the set second weight 1 and the set second weight 2 may be modified firstly, and then the transitional envelope information is calculated according to the set second weight 1 and the set second weight 2. Similarly, step 408 may be executed after step 409. That is, the set third weight 1 and the set third weight 2 may be modified firstly, and then the first envelope information is calculated according to the set third weight 1 and the set third weight 2.

Figure 5:
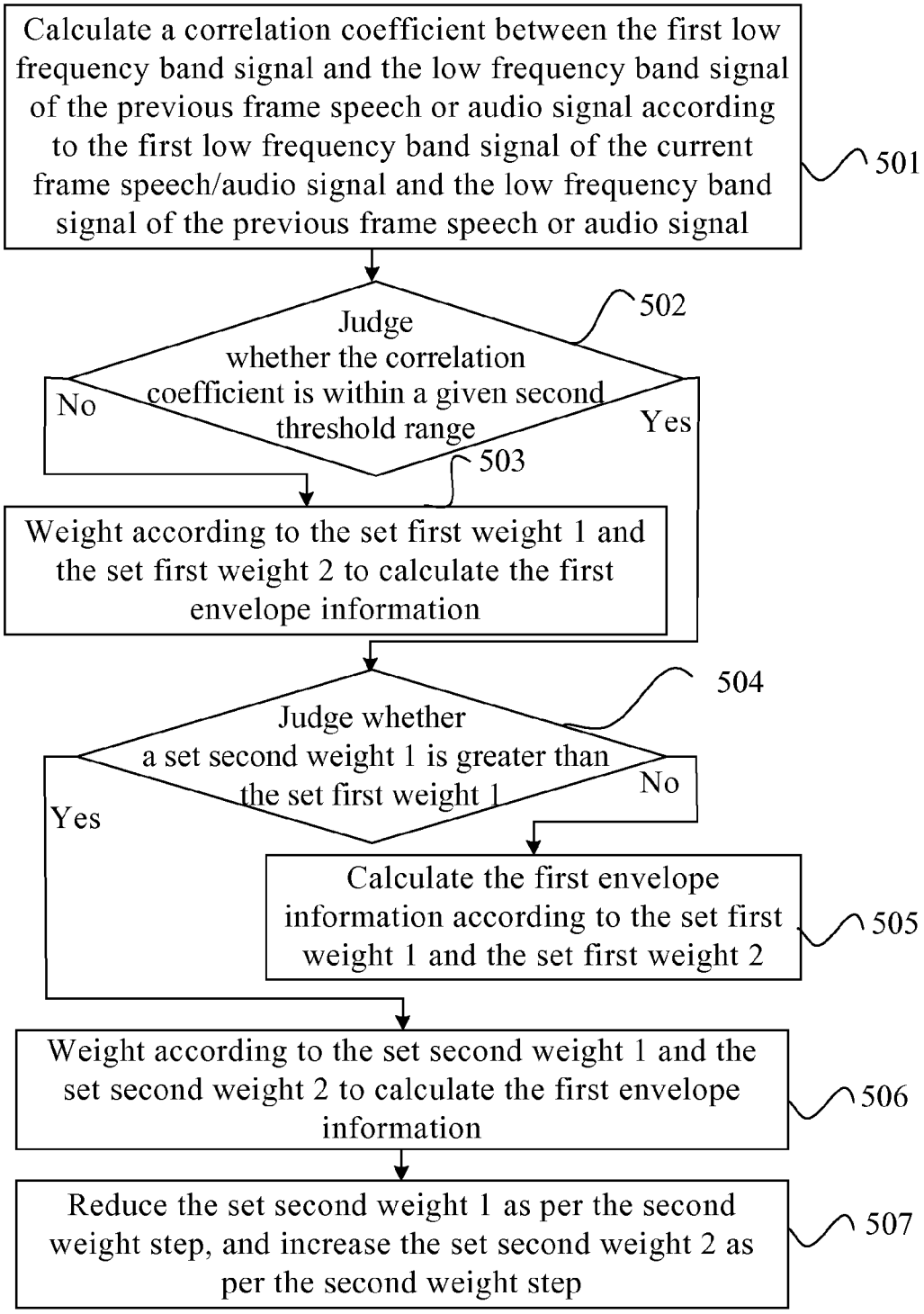
FIG. 5 is a second flowchart of another embodiment of step 302 shown in FIG. 3.

2. As shown in FIG. 5, another embodiment of obtaining the first envelope information through step 302 may further include the following steps:

Step 501: Calculate a correlation coefficient between the first low frequency band signal and the low frequency band signal of the previous frame of speech or audio signal according to the first low frequency band signal of the current frame of speech or audio signal and the low frequency band signal of the previous frame of speech or audio signal.

Specifically, to obtain more accurate first envelope information, the relationship between a frequency band of the first low frequency band signal of the current frame of speech or audio signal and the same frequency band of the low frequency band signal of the previous frame of speech or audio signal is calculated. In this embodiment, "con" may be used to indicate the correlation coefficient. This correlation coefficient is obtained according to the energy relationship between the first low frequency band signal of the current frame of speech or audio signal and the low frequency band signal of the previous frame of speech or audio signal. If the energy difference is small, the "corr" is large; otherwise, the "corr" is small. For the specific process, see the calculation about the correlation of the previous N frame of speech or audio signals in step 401.

Step 502: Judge whether the correlation coefficient is within a given second threshold range.

Specifically, after the value of the con is calculated in step 501, whether the calculated "corr" value is within the given second threshold is judged. For example, the second threshold range may be represented by c1 to c2 in this embodiment.

Step 503: If the correlation coefficient is not within the given second threshold range, weight according to the set first weight 1 and the set first weight 2 to calculate the first envelope information. The set first weight 1 refers to the weight value of the previous frame envelope information corresponding to the high frequency band signal of the previous frame of speech or audio signal, and the set first weight 2 refers to the weight value of the predicted envelope information. The set first weight 1 and the set second weight 2 are fixed constants.

Specifically, when the "corr" value is determined to be smaller than c1 or greater than c2, it is determined that the first envelope information corresponding to the current frame of speech or audio signal is slightly affected by the envelope information of the previous frame of speech or audio signal before the switching. Therefore, the first envelope information of the current frame is calculated according to the set first weight 1 and the set first weight 2. The product of the predicted envelope information and the set first weight 2 is added to the product of the previous frame envelope information and the set first weight 1, and the weighted sum is the first envelope information of the current frame. In addition, subsequently transmitted narrowband speech or audio signals are processed according to this method and weight. The first envelope information corresponding to the narrowband speech or audio signal is restored until the speech or audio signals with different bandwidths are switched again. For example, the set first weight 1 in this embodiment may be represented by a1; the set first weight 2 may be represented by b1; the previous frame envelope information may be represented by pre_fenv; the predicted envelope information may be represented by fenv; and the first envelope information may be represented by cur_fenv. In this case, step 503 may be represented by the following formula: cur_fenv=pre_fenv×a1+fenv×b1.

Step 504: If the correlation coefficient is within the second threshold range, judge whether the set second weight 1 is greater than the set first weight 1. The set second weight 1 refers to the weight value of the envelope information before the switching that corresponds to the high frequency band signal of the previous frame of speech or audio signal before the switching.

Specifically, if c1<corr<c2, the degree of the impact of the envelope information before the switching and the previous frame envelope information on the first envelope information of the current frame may be obtained by comparing the set second weight 1 with the set first weight 1.

Step 505: If the set second weight 1 is not greater than the set first weight 1, weight according to the set first weight 1 and the set first weight 2 to calculate the first envelope information.

Specifically, when the set second weight 1 is determined to be smaller than the set first weight 1 in step 504, it indicates that the current frame of speech or audio signal is a little far from the previous frame of speech or audio signal before the switching and that the first envelope information is slightly affected by the previous frame envelope information before the switching. Therefore, the first envelope information of the current frame may be calculated according to the set first weight 1 and the set first weight 2. In this case, step 505 may be represented by the following formula: cur_fenv=pre_fenv×a1+fenv×b1.

Step 506: If the set second weight 1 is greater than the set first weight 1, weight according to the set second weight 1 and the set second weight 2 to calculate the first envelope information. The set second weight 2 refers to the weight value of the predicted envelope information. For example, the set second weight 1 may be represented by a2, and the set second weight 2 may be represented by b2.

Specifically, when the set second weight 1 is determined to be greater than the set first weight 1 in step 504, it indicates that the current frame of speech or audio signal is closer to the first frequency band speech or audio signal of the previous frame before the switching and that the first envelope information is greatly affected by the envelope information before the switching that corresponds to the previous frame of speech or audio signal before the switching. Therefore, the first envelope information of the current frame may be calculated according to the set second weight 1 and the set second weight 2. In this case, the product of the predicted envelope information and the set second weight 2 is added to the product of the envelope information before the switching and the set second weight 1, and the weighted sum is the first envelope information of the current frame. The envelope information before the switching may be represented by con_fenv. In this case, step 506 may be represented by the following formula: cur_fenv=con_fenv×a2+fenv×b2.

Step 507: Decrease the set second weight 1 as per the second weight step, and increase the set second weight 2 as per the second weight step.

Specifically, as the speech or audio signals are transmitted, the impact of a speech or audio signal before the switching on the subsequent frame of speech or audio signal is gradually decreased. To calculate the first envelope information more accurately, adaptive adjustment needs to be performed on the set second weight 1 and the set second weight 2. The impact of the speech or audio signal before the switching on the subsequent frame of speech or audio signal is gradually decreased, while the impact of the previous frame of speech or audio signal close to the current frame of speech or audio signal turns larger gradually. Therefore, the value of the set second weight 1 turns smaller gradually, while the value of the set second weight 2 turns larger gradually. In this way, the impact of the envelope information before the switching on the first envelope information is weakened, while the impact of the predicted envelope information on the first envelope information is enhanced. In step 507, the set second weight 1 and the set second weight 2 may be modified according to the following formulas: New second weight 1=Old set second weight 1−First weight step; New second weight 2=Old set second weight 2+First weight step, where the first weight step is a set value.

The sum of the set first weight 1 and the set first weight 2 is equal to 1; the sum of the set second weight 1 and the set second weight 2 is equal to 1; the initial value of the set second weight 1 is greater than the initial value of the set first weight 1.

Step 303: Generate a processed first high frequency band signal according to the first envelope information and the predicted fine structure information.

Specifically, after the first envelope information of the current frame is obtained in step 302, the processed first high frequency band signal may be generated according to the first envelope information and predicted fine structure information, so that the second high frequency band signal can be smoothly switched to the processed first high frequency band signal.

By using the method for switching speech or audio signals in this embodiment, in the process of switching a speech or audio signal from a wide frequency band speech or audio signal to a narrow frequency band speech or audio signal, the processed first high frequency band signal of the current frame is obtained according to the predicted fine structure information and the first envelope information. In this way, the second high frequency band signal of the wide frequency band speech or audio signal before the switching can be smoothly switched to the processed first high frequency band signal corresponding to the narrow frequency band speech or audio signal, thus improving the quality of audio signals received by the user.

Figure 6:
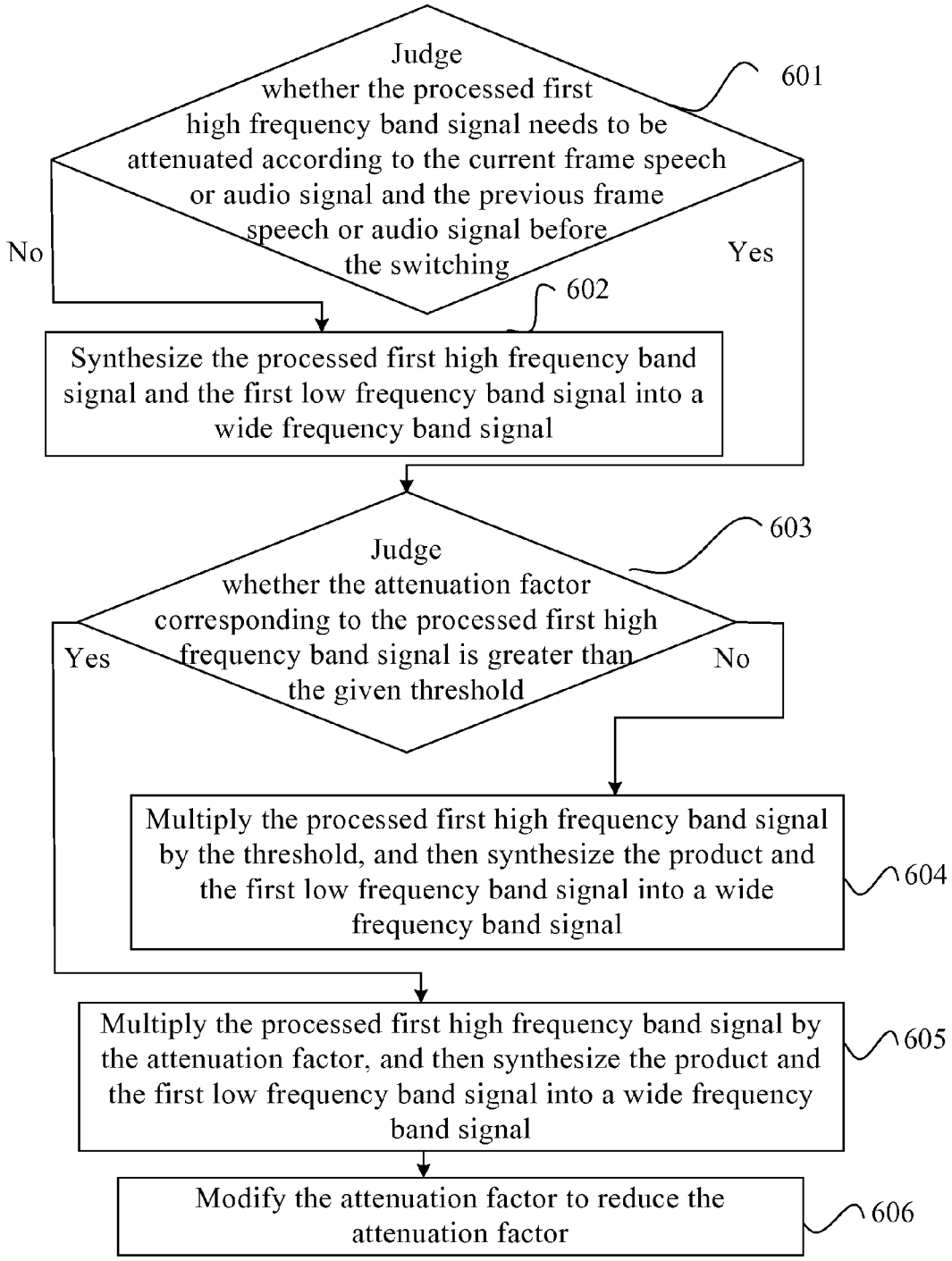
FIG. 6 is a flowchart of an embodiment of step 202 shown in FIG. 2.

Based on the preceding technical solution, step 202 shown in FIG. 6 includes the following steps:

Step 601: Judge whether the processed first high frequency band signal needs to be attenuated according to the current frame of speech or audio signal and the previous frame of speech or audio signal before the switching.

Specifically, the first high frequency band signal of the narrowband speech or audio signal is null. In the process of switching the wide frequency band speech or audio signal to the narrow frequency band speech or audio signal, to prevent the negative impact of the processed first high frequency band signal corresponding to the restored narrow frequency band speech or audio signal, the energy of the processed first high frequency band signal is attenuated by frames until the attenuation coefficient reaches a given threshold after the number of frames of the wide frequency band signal extended from the narrow frequency band speech or audio signal reaches a given number of frames. The interval between the current frame of speech or audio signal and the speech or audio signal of a frame before the switching may be obtained according to the current frame of speech or audio signal and the speech or audio signal of the frame before the switching. For example, the number of frames of the narrow frequency band speech or audio signal may be recorded by using a counter, where the number of frames may be a predetermined value greater than or equal to 0.

Step 602: If the processed first high frequency band signal does not need to be attenuated, synthesize the processed first high frequency band signal and the first low frequency band signal into a wide frequency band signal.

Specifically, if it is determined that the processed first high frequency band signal does not need to be attenuated in step 601, the processed first high frequency band signal and the first low frequency band signal are directly synthesized into a wide frequency band signal.

Step 603: If the processed first high frequency band signal needs to be attenuated, judge whether the attenuation factor corresponding to the processed first high frequency band signal is greater than the threshold.

Specifically, the initial value of the attenuation factor is 1, and the threshold is greater than or equal to 0 but less than 1. If it is determined that the processed first high frequency band signal needs to be attenuated in step 601, whether the attenuation factor corresponding to the processed first high frequency band signal is greater than a given threshold is judged in step 603.

Step 604: If the attenuation factor is not greater than the given threshold, multiply the processed first high frequency band signal by the threshold, and synthesize the product and the first low frequency band signal into the wide frequency band signal.

Specifically, if the attenuation factor is determined to be not greater than the given threshold in step 603, it indicates that the energy of the processed first high frequency band signal is already attenuated to a certain degree and that the processed first high frequency band signal may not cause negative impacts. In this case, this attenuation ratio may be kept. Then, the processed first high frequency band signal is multiplied by the threshold, and then the product and the first low frequency band signal are synthesized into a wide frequency band signal.

Step 605: If the attenuation factor is greater than the given threshold, multiply the processed first high frequency band signal by the attenuation factor, and synthesize the product and the first low frequency band signal into the wide frequency band signal.

Specifically, if the attenuation factor is greater than the given threshold in step 603, it indicates that the processed first high frequency band signal may cause poor listening at the attenuation factor and needs to be further attenuated until it reaches the given threshold. Then, the processed first high frequency band signal is multiplied by the attenuation factor, and then the product and the first low frequency band signal are synthesized into a wide frequency band signal.

Step 606: Modify the attenuation factor to decrease the attenuation factor.

Specifically, as the speech or audio signals are transmitted, the impact of the speech or audio signals before the switching on subsequent narrowband speech or audio signals gradually turns smaller, and the attenuation factor also turns smaller gradually.

Figure 7:
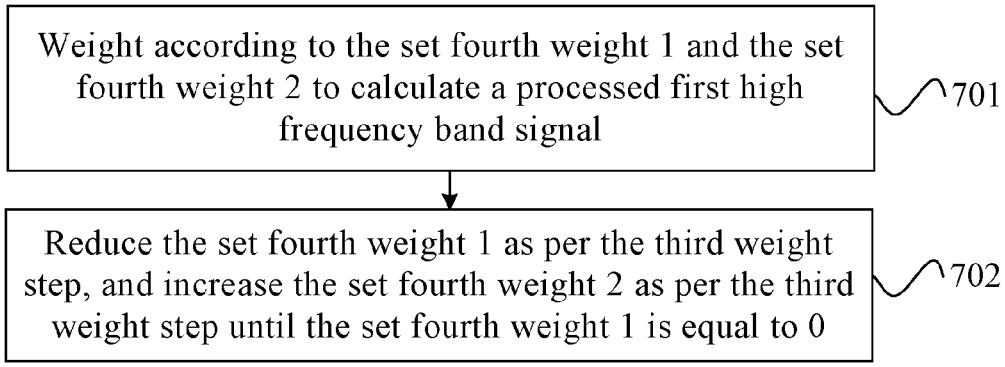
FIG. 7 is a second flowchart of another embodiment of step 201 shown in FIG. 2.

Optionally, based on the preceding technical solution, when switching from a narrow frequency band speech or audio signal a wide frequency band speech or audio signal, an embodiment of obtaining the processed first high frequency band signal through step 201 includes the following steps, as shown in FIG. 7:

Step 701: Weight according to the set fourth weight 1 and the set fourth weight 2 to calculate a processed first high frequency band signal. The set fourth weight 1 refers to the weight value of the second high frequency band signal, and the set fourth weight 2 refers to the weight value of the first high frequency band signal of the current frame of speech or audio signal.

Specifically, in the process of switching the narrow frequency band speech or audio signal to the wide frequency band speech or audio signal, because the high frequency band signal of the wide frequency band speech or audio signal is not null but the high frequency band signal corresponding to the narrow frequency band speech or audio signal is null, the energy of the high frequency band signal of the wide frequency band speech or audio signal needs to be attenuated to ensure that the narrow frequency band speech or audio signal can be smoothly switched to the wide frequency band speech or audio signal. The product of the second high frequency band signal and the set fourth weight 1 is added to the product of the first high frequency band signal and the set fourth weight 2; the weighted value is the processed first high frequency band signal.

Step 702: Decrease the set fourth weight 1 as per the third weight step, and increase the set fourth weight 2 as per the third weight step until the set fourth weight 1 is equal to 0. The sum of the set fourth weight 1 and the set fourth weight 2 is equal to 1.

Specifically, as the speech or audio signals are transmitted, the impact of the narrow frequency band speech or audio signals before the switching on subsequent wide frequency band speech or audio signals gradually turns smaller. Therefore, the set fourth weight 1 gradually turns smaller, while the set fourth weight 2 gradually turns larger until the set fourth weight 1 is equal to 0 and the set fourth weight 2 is equal to 1. That is, the transmitted speech or audio signals are always wide frequency band speech or audio signals.

Figure 8:
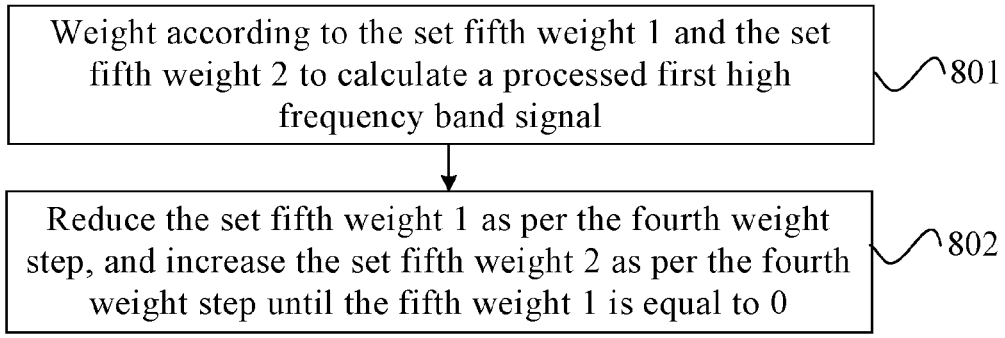
FIG. 8 is a third flowchart of another embodiment of step 201 shown in FIG. 2.

Similarly, as shown in FIG. 8, another embodiment of obtaining the processed first high frequency band signal through step 201 may further include the following steps:

Step 801: Weight according to the set fifth weight 1 and the fifth weight 2 to calculate a processed first high frequency band signal. The fifth weight 1 is the weight value of a set fixed parameter, and the fifth weight 2 is the weight value of the first high frequency band signal of the current frame of speech or audio signal.

Specifically, because the first high frequency band signal of the narrow frequency band speech or audio signal is null, a fixed parameter may be set to replace the high frequency band signal of the narrow frequency band speech or audio signal, where the fixed parameter is a constant that is greater than or equal to 0 and smaller than the energy of the first high frequency band signal. The product of the fixed parameter and the fifth weight 1 is added to the product of the first high frequency band signal and the fifth weight 2; the weighted value is the processed first high frequency band signal.

Step 802: Decrease the fifth weight 1 as per the fourth weight step, and increase the fifth weight 2 as per the fourth weight step until the fifth weight 1 is equal to 0. The sum of the fifth weight 1 and the fifth weight 2 is equal to 1.

Specifically, as the speech or audio signals are transmitted, the impact of the narrow frequency band speech or audio signals before the switching on subsequent wide frequency band speech or audio signals gradually turns smaller. Therefore, the fifth weight 1 gradually turns smaller, while the fifth weight 2 gradually turns larger until the fifth weight 1 is equal to 0 and the fifth weight 2 is equal to 1. That is, the transmitted speech or audio signals are always real wide frequency band speech or audio signals.

By using the method for switching speech or audio signals in this embodiment, in the process of switching a speech or audio signal from a narrow frequency band speech or audio signal to a wide frequency band speech or audio signal, the high frequency band signal of the wide frequency band speech or audio signal is attenuated to obtain a processed high frequency band signal. In this way, the high frequency band signal corresponding to the narrow frequency band speech or audio signal before the switching can be smoothly switched to the processed high frequency band signal corresponding to the wide frequency band speech or audio signal, thus helping to improve the quality of audio signals received by the user.

In this embodiment, the envelope information may also be replaced by other parameters that can represent the high frequency band signal, for example, a linear predictive coding (LPC) parameter or an amplitude parameter.

Those skilled in the art may understand that all or a part of the steps of the method according to the embodiments of the present invention may be implemented by a program instructing relevant hardware. The program may be stored in a computer readable storage medium. When the program runs, the steps of the method according to the embodiments of the present invention are performed. The storage medium may be a read only memory (ROM), a random access memory (RAM), a magnetic disk, or a compact disk-read only memory (CD-ROM).

Figure 9:
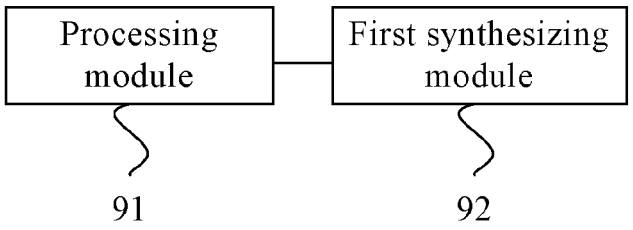
FIG. 9 shows a structure of a first embodiment of an apparatus for switching speech or audio signals.

FIG. 9 shows a structure of the first embodiment of an apparatus for switching speech or audio signals. As shown in FIG. 9, the apparatus for switching speech or audio signals includes a processing module 91 and a first synthesizing module 92.

The processing module 91 is configured to weight the first high frequency band signal of the current frame of speech or audio signal and the second high frequency band signal of a previous M frame of speech or audio signals to obtain a processed first high frequency band signal when switching of a speech or audio. M is greater than or equal to 1.

The first synthesizing module 92 is configured to synthesize the processed first high frequency band signal and the first low frequency band signal of the current frame of speech or audio signal into a wide frequency band signal.

In the apparatus for switching speech or audio signals in this embodiment, the processing module processes the first high frequency band signal of the current frame of speech or audio signal according to the second high frequency band signal of a previous M frame of speech or audio signals, so that the second high frequency band signal can be smoothly switched to the processed first high frequency band signal. In this way, during the process of switching between speech or audio signals with different bandwidths, the high frequency band signal of these speech or audio signals can be smoothly switched. Finally, the first synthesizing module synthesizes the processed first high frequency band signal and the first low frequency band signal into a wide frequency band signal; the wide frequency band signal is transmitted to a user terminal, so that the user enjoys a high quality speech or audio signal. By using the method for switching speech or audio signals in this embodiment, speech or audio signals with different bandwidths can be switched smoothly, thus reducing the impact of the sudden energy change on the subjective audio quality of the speech or audio signals and improving the quality of audio signals received by the user.

Figure 10:
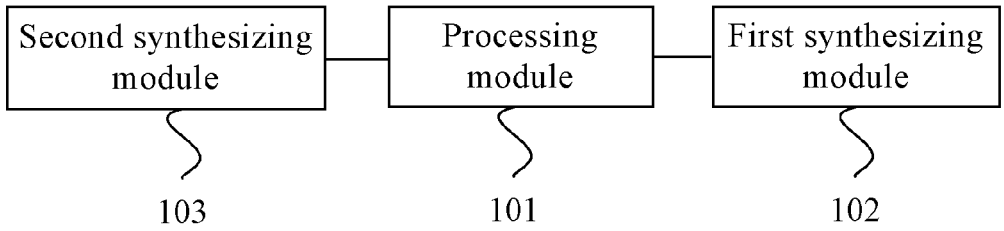
FIG. 10 shows a structure of a second embodiment of the apparatus for switching speech or audio signals.

FIG. 10 shows a structure of the second embodiment of the apparatus for switching speech or audio signals. As shown in FIG. 10, the apparatus for switching speech or audio signals in this embodiment is based on the first embodiment, and further includes a second synthesizing module 103.

The second synthesizing module 103 is configured to synthesize the first high frequency band signal and the first low frequency band signal into the wide frequency band signal when a switching of the speech or audio signal does not occurs.

Figure 11:
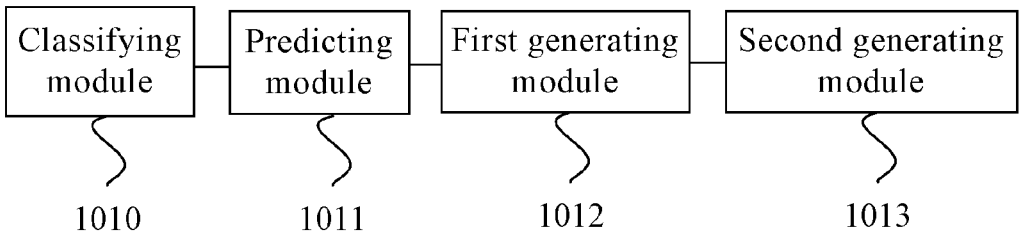
FIG. 11 is a first schematic diagram illustrating a structure of a processing module in the second embodiment of the apparatus for switching speech or audio signals.

In the apparatus for switching speech or audio signal in this embodiment, the second synthesizing module is set to synthesize the first low frequency band signal and the first high frequency band signal of the first frequency band speech or audio signals of the current frame into a wide frequency band signal when switching between speech or audio signals with different bandwidths. In this way, the quality of speech or audio signals received by the user is improved. According to the preceding technical solution, optionally, when switching from wide frequency band speech or audio signal to a narrow frequency band speech or audio signal, the processing module 101 includes the following modules, as shown in FIG. 10 and FIG. 11: a predicting module 1011, to Predict a fine structure information and an envelope information corresponding to the first high frequency band signal; a first generating module 1012, to weight the predicted envelope information and the previous M frame envelope information corresponding to the second high frequency band signal of a previous M frame of speech or audio signals to obtain first envelope information corresponding to the first high frequency band signal; and a second generating module 1013, to generate a processed first high frequency band signal according to the first envelope information and the predicted fine structure information.

Further, the apparatus for switching speech or audio signals in this embodiment may include a classifying module 1010 configured to classify the first low frequency band signal of the current frame of speech or audio signal. The predicting module 1011 is further configured to predict the fine structure information and envelope information corresponding to the first low frequency band signal of the current frame of speech or audio signal.

In the apparatus for switching speech or audio signals in this embodiment, the predicting module predicts the fine structure information and envelope information corresponding to the first high frequency band signal, so that the processed first high frequency band signal can be accurately generated by the first generating module and the second generating module. In this way, the first high frequency band signal can be smoothly switched to the processed first high frequency band signal, thus improving the quality of speech or audio signals received by the user. In addition, the classifying module classifies the first low frequency band signal of the current frame of speech or audio signal; the predicting module obtains the predicted fine structure information and predicted envelope information according to the signal type. In this way, the predicted fine structure information and predicted envelope information are more accurate, thus improving the quality of speech or audio signals received by the user.

Figure 12:
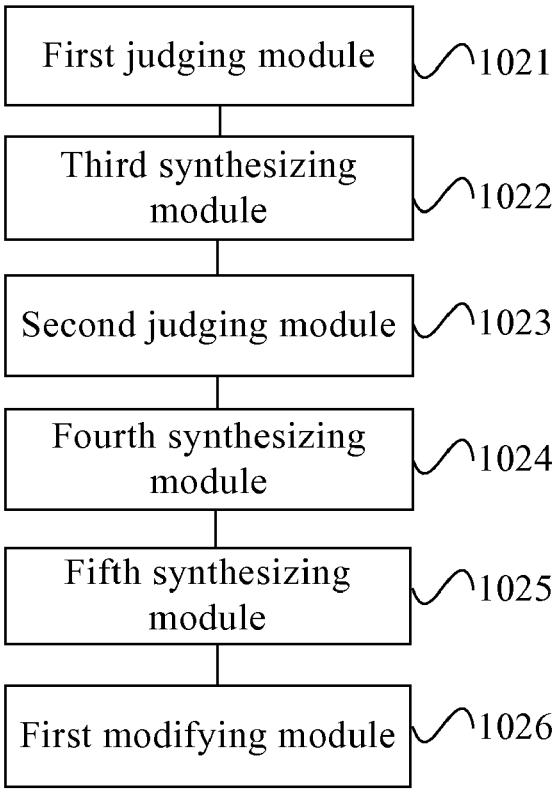
FIG. 12 is a schematic diagram illustrating a structure of a first module in the second embodiment of the apparatus for switching speech or audio signals.

Based on the preceding technical solution, optionally, the first synthesizing module 102 includes the following modules, as shown in FIG. 10 and FIG. 12: a first judging module 1021, to judge whether the processed first high frequency band signal needs to be attenuated according to the current frame of speech or audio signal and the previous frame of speech or audio signal before the switching; a third synthesizing module 1022, to synthesize the processed first high frequency band signal and the first low frequency band signal into a wide frequency band signal when the first judging module 1021 determines that the processed first high frequency band signal does not need to be attenuated; a second judging module 1023, to judge whether the attenuation factor corresponding to the processed first high frequency band signal is greater than the given threshold when the first judging module 1021 determines that the processed first high frequency band signal needs to be attenuated; a fourth synthesizing module 1024, to: if the second judging module 1023 determines that the attenuation factor is not greater than the given threshold, multiply the processed first high frequency band signal by the threshold, and synthesize the product and the first low frequency band signal into a wide frequency band signal; a fifth synthesizing module 1025, to: if the second judging module 1023 determines that the attenuation factor is greater than the given threshold, multiply the processed first high frequency band signal by the attenuation factor, and synthesize the product and the first low frequency band signal into a wide frequency band signal; and a first modifying module 1026, to modify the attenuation factor to decrease the attenuation factor.

The initial value of the attenuation factor is 1, and the threshold is greater than or equal to 0 but less than 1.

By using the apparatus for switching speech or audio signals, the processed first high frequency band signal is attenuated, so that the wide frequency band signal obtained by processing the current frame of speech or audio signal is more accurate, thus improving the quality of audio signals received by the user.

Figure 13A:
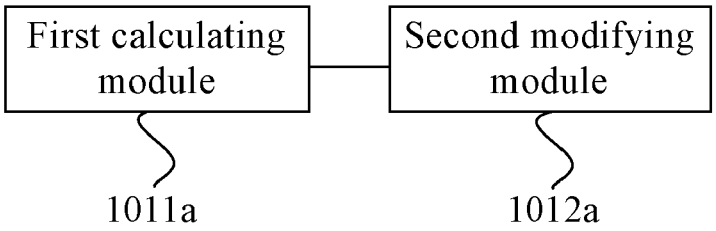
FIG. 13*a* is a second schematic diagram illustrating a structure of the processing module in the second embodiment of the apparatus for switching speech or audio signals.

According to the preceding technical solution, optionally, when switching from a narrow frequency band speech or audio signal a wide frequency band speech or audio signal, the processing module 101 in this embodiment includes the following modules, as shown in FIG. 10 and FIG. 13*a*: a first calculating module 1011*a*, to weight according to a set fourth weight 1 and a fourth weight 2 to calculate the processed first high frequency band signal, where the set fourth weight 1 refers to the weight value of the second high frequency band signal and the set fourth weight 2 refers to the weight value of the first high frequency band signal; and a second modifying module 1012*a*, to: decrease the set fourth weight 1 as per the third weight step, and increase the set fourth weight 2 as per the third weight step until the set fourth weight 1 is equal to 0, where the sum of the set fourth weight 1 and the set fourth weight 2 is equal to 1.

Figure 13B:
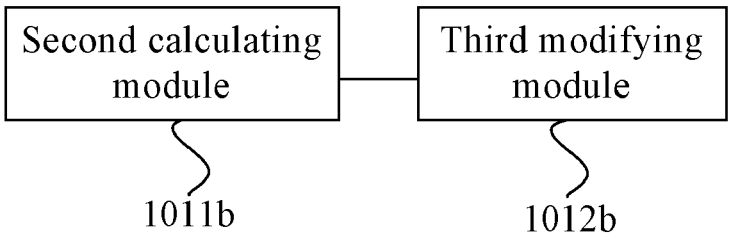
FIG. 13*b* is a third schematic diagram illustrating a structure of the processing module in the second embodiment of the apparatus for switching speech or audio signals.

Similarly, when switching from a narrow frequency band speech or audio signal a wide frequency band speech or audio signal, the processing module 101 in this embodiment may further include the following modules, as shown in FIG. 10 and FIG. 13*b*: a second calculating module 1011*b*, to weight according to a set fifth weight 1 and a fifth weight 2 to calculate the processed first high frequency band signal, where the fifth weight 1 refers to the weight value of a set fixed parameter, and the fifth weight 2 refers to the weight value of the first high frequency band signal; and a third modifying module 1012*b*, to: decrease the fifth weight 1 as per the fourth weight step, and increase the fifth weight 2 as per the fourth weight step until the fifth weight 1 is equal to 0, where the sum of the fifth weight 1 and the fifth weight 2 is equal to 1, where the fixed parameter is a fixed constant greater than or equal to 0 and smaller than the energy value of the first high frequency band signal.

By using the apparatus for switching speech or audio signals in this embodiment, in the process of switching a speech or audio signal from a narrow frequency band speech or audio signal to a wide frequency band speech or audio signal, the high frequency band signal of the wide frequency band speech or audio signal is attenuated to obtain a processed high frequency band signal. In this way, the high frequency band signal corresponding to the narrow frequency band speech or audio signal before the switching can be smoothly switched to the processed high frequency band signal corresponding to the wide frequency band speech or audio signal, thus helping to improve the quality of audio signals received by the user.

It should be noted that the above embodiments are merely provided for describing the technical solution of the present invention, but not intended to limit the present invention. Although the present invention has been described in detail with reference to the foregoing embodiments, it is apparent that those skilled in the art can make various modifications and variations to the invention without departing from the spirit and scope of the invention. The invention shall cover the modifications and variations provided that they fall in the scope of protection defined by the following claims or their equivalents.

What is claimed is:

1. A method for switching speech or audio signals, comprising:

when switching of a speech or audio, weighting a first high frequency band signal of a current frame of speech or audio signal and a second high frequency band signal of a previous M frame of speech or audio signals to obtain a processed first high frequency band signal, wherein M is greater than or equal to 1, and wherein the previous M frame of speech or audio signals refer to an M frame of speech or audio signals before the current frame; and synthesizing the processed first high frequency band signal and a first low frequency band signal of the current frame of speech or audio signal into a wide frequency band signal, wherein when switching from a wide frequency band speech or audio signal to a narrow frequency band speech or audio signal, weighting the first high frequency band signal of the current frame of speech or audio signal and the second high frequency band signal of the previous M frame of speech or audio signals to obtain the processed first high frequency band signal comprises:

predicting a fine structure information and an envelope information corresponding to the first high frequency band signal of the current frame of speech or audio signal;

weighting the predicted envelope information and a previous M frame envelope information corresponding to the second high frequency band signal of the previous M frame of speech or audio signals to obtain a first envelope information corresponding to the first high frequency band signal; and generating the processed first high frequency band signal according to the first envelope information and the predicted fine structure information.

2. The method of claim 1, wherein predicting the fine structure information and the envelope information corresponding to the first high frequency band signal of the current frame of speech or audio signal comprises:

classifying the first low frequency band signal of the current frame of speech or audio signal; and predicting the fine structure information and the envelope information according to a signal type of the first low frequency band signal.

3. The method of claim 1, wherein weighting the predicted envelope information and the previous M frame envelope information corresponding to the second high frequency band signal of the previous M frame of speech or audio signals to obtain the first envelope information corresponding to the first high frequency band signal comprises:

calculating a correlation coefficient between the first low frequency band signal and a low frequency band signal of a previous N frame of speech or audio signals according to the first low frequency band signal and the low frequency band signal of the previous N frame of speech or audio signals, wherein N is greater than or equal to 1;

judging whether the correlation coefficient is within a given first threshold range;

if the correlation coefficient is not within the first threshold range, weighting according to a set first weight 1 and a set first weight 2 to calculate the first envelope information, wherein the set first weight 1 refers to a weight value of a previous frame envelope information corresponding to a high frequency band signal of a previous frame of speech or audio signal, and wherein the set first weight 2 refers to a weight value of the predicted envelope information;

if the correlation coefficient is within the first threshold range, weighting according to a set second weight 1 and a set second weight 2 to calculate a transitional envelope information, wherein the set second weight 1 refers to a weight value of an envelope information corresponding to a high frequency band signal of an L frame of speech or audio signals before the switching, wherein the set second weight 2 refers to the weight value of the previous M frame envelope information, and wherein L is greater than or equal to 1;

decreasing the set second weight 1 as per a first weight step, and increasing the set second weight 2 as per the first weight;

judging whether a set third weight 1 is greater than the set first weight 1;

if the set third weight 1 is not greater than the set first weight 1, weighting according to the set first weight 1 and the set first weight 2 to calculate the first envelope information;

if the set third weight 1 is greater than the set first weight 1, weighting according to the set third weight 1 and a set third weight 2 to calculate the first envelope information, wherein the set third weight 1 refers to a weight value of the transitional envelope information, and wherein the set third weight 2 refers to a weight value of the predicted envelope information; and decreasing the set third weight 1 as per a second weight, and increasing the set third weight 2 as per the second weight step until the set third weight 1 is equal to 0;

wherein a sum of the set first weight 1 and the set first weight 2 is equal to 1, wherein a sum of the set second weight 1 and the set second weight 2 is equal to 1, wherein a sum of the set third weight 1 and the set third weight 2 is equal to 1, wherein an initial value of the set third weight 1 is greater than an initial value of the set first weight 1, and wherein the set first weight 1 and the set first weight 2 are fixed constants.

4. The method of claim 1, wherein weighting the predicted envelope information and the previous M frame envelope information corresponding to the second high frequency band signal of the previous M frame of speech or audio signals to obtain the first envelope information corresponding to the first high frequency band signal comprises:

calculating a correlation coefficient between the first low frequency band signal of a current frame and a low frequency band signal of a previous frame of speech or audio signal according to the first low frequency band signal of the current frame and the low frequency band signal of the previous frame of speech or audio signal;

judging whether the correlation coefficient is within a given second threshold range;

if the correlation coefficient is not within the second threshold range, weighting according to a set first weight 1 and a set first weight 2 to calculate the first envelope information, wherein the set first weight 1 refers to a weight value of a previous frame envelope information corresponding to a high frequency band signal of the previous frame of speech or audio signal, wherein the set first weight 2 refers to a weight value of the predicted envelope information, and wherein the set first weight 1 and the set first weight 2 are fixed constants;

if the correlation coefficient is within the second threshold range, judging whether a set second weight 1 is greater than the set first weight 1, wherein the set second weight 1 refers to a weight value of an envelope information corresponding to the high frequency band signal of the previous frame of speech or audio signal before the switching;

if the set second weight 1 is not greater than the set first weight 1, weighting according to the set first weight 1 and the set first weight 2 to calculate the first envelope information;

if the set second weight 1 is greater than the set first weight 1, weighting according to the set second weight 1 and a set second weight 2 to calculate the first envelope information, wherein the set second weight 2 refers to a weight value of the predicted envelope information; and decreasing the set second weight 1 as per a second weight, and increasing the set second weight 2 as per the second weight step, wherein a sum of the set first weight 1 and the set first weight 2 is equal to 1, wherein a sum of the set second weight 1 and the set second weight 2 is equal to 1, and wherein an initial value of the set second weight 1 is greater than an initial value of the set first weight 1.

5. The method of claim 1, wherein synthesizing the processed first high frequency band signal and the first low frequency band signal of the current frame of speech or audio signal into the wide frequency band signal comprises:

judging whether the processed first high frequency band signal needs to be attenuated according to the current frame of speech or audio signal and a previous frame of speech or audio signal before the switching;

if attenuation is not required, synthesizing the processed first high frequency band signal and the first low frequency band signal into the wide frequency band signal;

if attenuation is required, judging whether an attenuation factor corresponding to the first high frequency band signal is greater than a given threshold;

if the attenuation factor is not greater than the given threshold, multiplying the processed first high frequency band signal by the threshold, and synthesizing the product of the processed first high frequency band signal and the threshold and the first low frequency band signal into the wide frequency band signal;

if the attenuation factor is greater than the given threshold, multiplying the processed first high frequency band signal by the attenuation factor, and synthesizing the product of the processed first high frequency band signal and the attenuation factor and the first low frequency band signal into the wide frequency band signal; and modifying the attenuation factor to decrease the attenuation factor, wherein an initial value of the attenuation factor is 1, and wherein the threshold is greater than or equal to 0 but less than 1.

6. An apparatus for switching speech or audio signals, comprising:

a processing module, configured to when switching of a speech or audio, weight a first high frequency band signal of a current frame of speech or audio signal and a second high frequency band signal of a previous M frame of speech or audio signals to obtain a processed first high frequency band signal, wherein M is greater than or equal to 1; and a first synthesizing module, configured to synthesize the processed first high frequency band signal and a first low frequency band signal of the current frame of speech or audio signal into a wide frequency band signal, wherein when switching from a wide frequency band speech or audio signal to a narrow frequency band speech or audio signal, the processing module comprises:

a predicting module, configured to predict a fine structure information and an envelope information corresponding to the first high frequency band signal of the current frame of speech or audio signal;

a first generating module, configured to weight the predicted envelope information and a previous M frame envelope information corresponding to the second high frequency band signal of the previous M frame of speech or audio signals to obtain a first envelope information corresponding to the first high frequency band signal; and a second generating module, configured to generate the processed first high frequency band signal according to the first envelope information and the predicted fine structure information.

7. The apparatus of claim 6 further comprising a classifying module configured to classify the first low frequency band signal of the current frame of speech or audio signal, wherein the predicting module is further configured to predict the fine structure information and the envelope information according to a signal type of the first low frequency band signal.

8. The apparatus of claim 6, wherein the first synthesizing module comprises:

a first judging module, configured to judge whether the processed first high frequency band signal needs to be attenuated according to the current frame of speech or audio signal and a previous frame of speech or audio signal before the switching;

a third synthesizing module, configured to synthesize the processed first high frequency band signal and the first low frequency band signal into the wide frequency band signal when the first judging module determines that the processed first high frequency band signal does not need to be attenuated;

a second judging module, configured to judge whether an attenuation factor corresponding to the processed first high frequency band signal is greater than a given threshold when the first judging module determines that the processed first high frequency band signal needs to be attenuated;

a fourth synthesizing module, wherein when the second judging module determines that the attenuation factor is not greater than the given threshold, the fourth synthesizing module is configured to:

multiply the processed first high frequency band signal by the threshold; and synthesize the product and the first low frequency band signal into the wide frequency band signal;

a fifth synthesizing module, wherein when the second judging module determines that the attenuation factor is greater than the given threshold, the fifth synthesizing module is configured to:

multiply the processed first high frequency band signal by the attenuation factor; and synthesize the product and the first low frequency band signal into the wide frequency band signal; and a first modifying module, configured to modify the attenuation factor to decrease the attenuation factor, wherein an initial value of the attenuation factor is 1, and wherein the threshold is greater than or equal to 0 but less than 1.

9. An apparatus for switching speech or audio signals, comprising:

a processing module, configured to when switching of a speech or audio, weight a first high frequency band signal of a current frame of speech or audio signal and a second high frequency band signal of a previous M frame of speech or audio signals to obtain a processed first high frequency band signal, wherein M is greater than or equal to 1; and a first synthesizing module, configured to synthesize the processed first high frequency band signal and a first low frequency band signal of the current frame of speech or audio signal into a wide frequency band signal, wherein when switching from a narrow frequency band speech or audio signal to a wide frequency band speech or audio signal, the processing module comprises:

a first calculating module, configured to weight according to a set fourth weight 1 and a set fourth weight 2 to calculate the processed first high frequency band signal, wherein the set fourth weight 1 refers to a weight value of the second high frequency band signal, and wherein the set fourth weight 2 refers to a weight value of the first high frequency band signal; and a second modifying module, configured to decrease the set fourth weight 1 as per a third weight step and increase the set fourth weight 2 as per the third weight step until the set fourth weight 1 is equal to 0, wherein a sum of the set fourth weight 1 and the set fourth weight 2 is equal to 1.

10. The apparatus of claim 9, wherein when switching from a narrow frequency band speech or audio signal to a wide frequency band speech or audio signal, the processing module comprises:

a second calculating module, configured to weight according to a set fifth weight 1 and a set fifth weight 2 to calculate the processed first high frequency band signal, wherein the set fifth weight 1 refers to a weight value of a set fixed parameter, and wherein the set fifth weight 2 refers to a weight value of the first high frequency band signal; and a third modifying module, configured to decrease the set fifth weight 1 as per a fourth weight step, and increase the set fifth weight 2 as per the fourth weight step until the set fifth weight 1 is equal to 0, wherein a sum of the set fifth weight 1 and the set fifth weight 2 is equal to 1, wherein the fixed parameter is a constant that is greater than or equal to 0 but less than an energy value of the first high frequency band signal.

* * * * *